United States Patent [19]

Churchman

[11] 4,206,566

[45] Jun. 10, 1980

[54] TOY NOVELTY DEVICE

[76] Inventor: Fred L. Churchman, 451 Maxine Dr., Baton Rouge, La. 70808

[21] Appl. No.: 937,339

[22] Filed: Aug. 28, 1978

Related U.S. Application Data

[63] Continuation-in-part of Ser. No. 810,315, Jun. 27, 1977, abandoned.

[51] Int. Cl.[2] ..... A63H 33/00

[52] U.S. Cl. ..... 46/47; 84/477 B

[58] Field of Search ..... 46/47, 51, 52; 84/477 B; 362/102

[56] References Cited

U.S. PATENT DOCUMENTS

| | | | |
|---|---|---|---|
| 1,590,573 | 6/1926 | Frye et al. | 46/47 |
| 2,450,545 | 10/1948 | Foster | 84/477 B |
| 2,812,683 | 11/1957 | Harrold et al. | 84/477 B |
| 3,114,550 | 12/1963 | Hughes | 46/47 X |

OTHER PUBLICATIONS

"Twirl-Aton", Peer Products Co., St. Louis, Mo. *Playthings,* Sep. 1959.

*Primary Examiner*—Louis G. Mancene
*Assistant Examiner*—Mickey Yu
*Attorney, Agent, or Firm*—Roy, Kiesel, Patterson & Abadie

[57] ABSTRACT

A toy device comprising a hand-held manipulating handle having an opening at one end through which at least one end of a straight, round shaft can pass.

9 Claims, 9 Drawing Figures

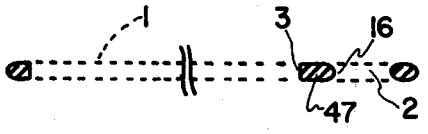
FIG. 3.
FIG. 3A.
FIG. 3B.
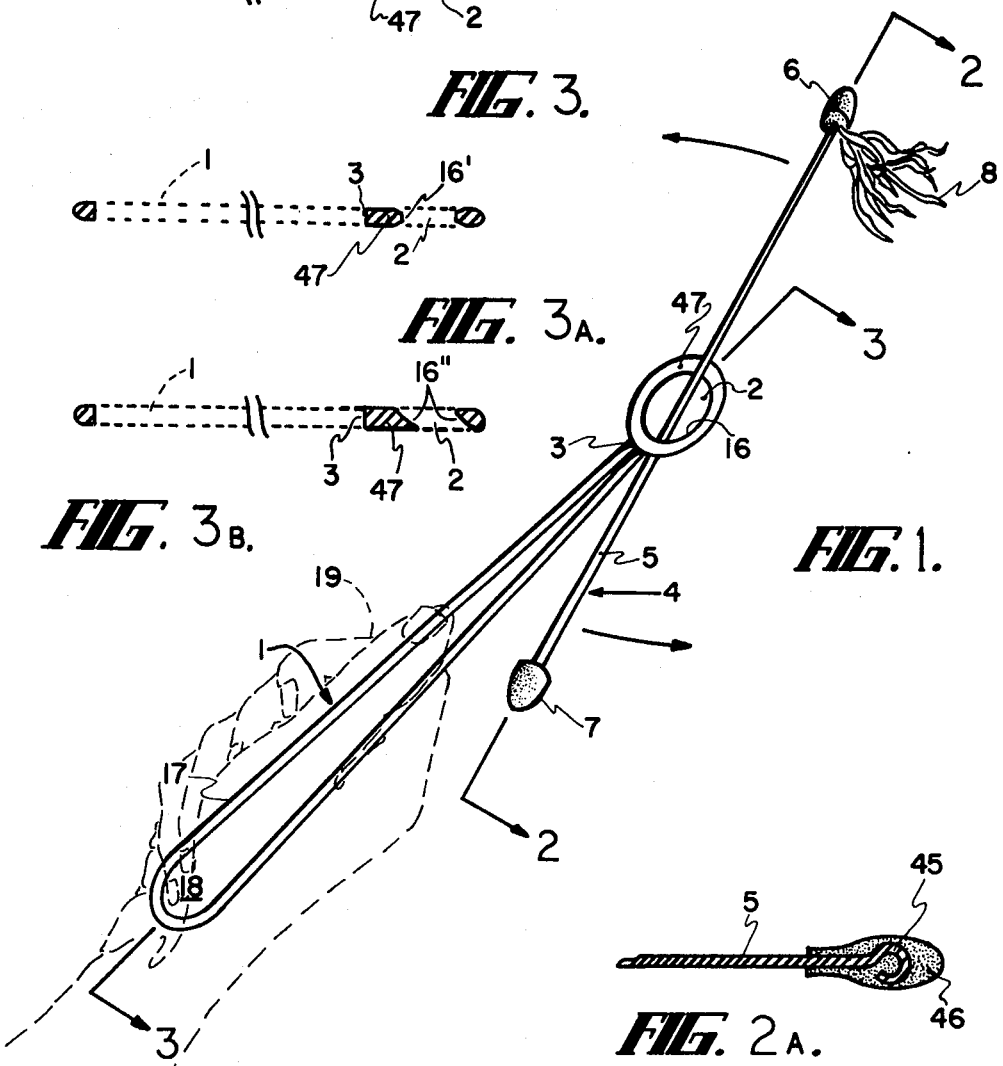
FIG. 1.
FIG. 2A.
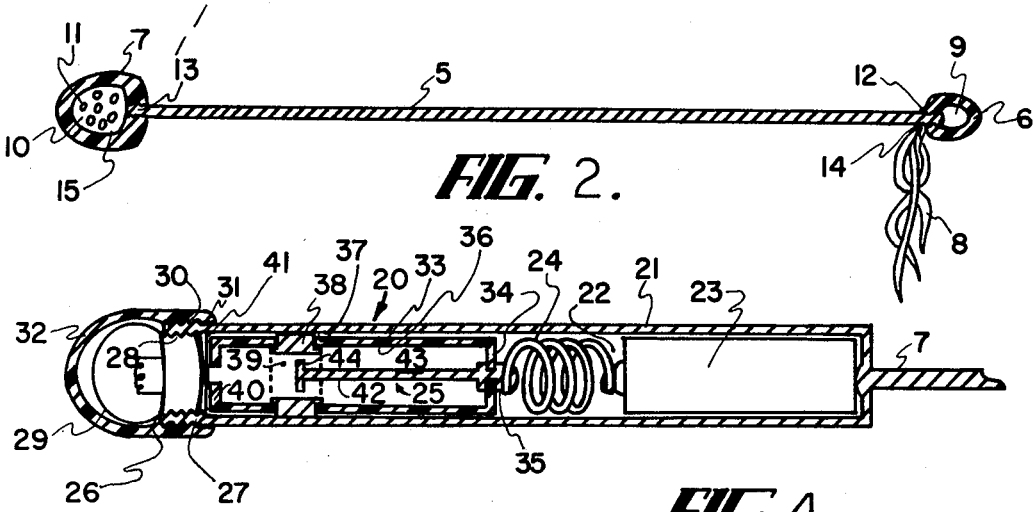
FIG. 2.
FIG. 4.

TOY NOVELTY DEVICE

RELATED APPLICATIONS

This application is a continuation-in-part of United States Patent Application Ser. No. 810,315, filed June 27, 1977 by the inventor herein and entitled "Toy Novelty Device", and mention thereof is made for purposes of obtaining benefit of its filing date. The above application has been abandoned.

BACKGROUND OF THE INVENTION

1. Field of the Invention. This invention relates in general to amusement devices and, more particularly, to spinning and whirling devices.

2. Prior Art. There have been many devices developed for amusement that utilize motion. Examples of these can be seen in Fletcher U.S. Pat. No. 3,120,147, issued Feb. 4, 1964, and entitled "Baton Device and Twirl Holder Therefor", Hughes U.S. Pat. No. 3,114,550, issued Dec. 17, 1963, and entitled "Recreational Bounce Type Device", Alonso U.S. Pat. No. 3,439,446, issued Apr. 22, 1969, and entitled "Children's Streamer Toy", Manoloff U.S. Pat. No. 2,681,979, issued June 22, 1954, and entitled "Illuminated Baton", and Frye, et al U.S. Pat. No. 1,590,573, issued June 29, 1926, entitled "Toy". However, these and other devices do not provide the constant human manipulation, competition and skill desired. In many other cases, a particular amusement device either does not appeal to as broad an age range as desired or are too expensive for the general consumer.

SUMMARY OF THE INVENTION

Therefore, one object of this invention is to provide an amusement device that requires constant human manipulation.

Another object of this invention is to provide an amusement device requiring physical skill and mental concentration.

Still another object of this invention is to provide an amusement device which appeals to a wide age range.

Accordingly, an amusement device is provided comprising a hand-held manipulating means having an opening in one end through which a weighted orbiting rod can pass.

BRIEF DESCRIPTION OF THE DRAWINGS

FIG. 1 is a perspective view of one embodiment of this invention.

FIG. 2 is a cross-sectional view taken along lines 2—2 of FIG. 1.

FIG. 2A is a cutaway cross-sectional view of one embodiment of one shaft end.

FIG. 3 is a cross-sectional view taken along lines 3—3 of FIG. 1.

FIG. 3A is a cross-sectional view similar to that of FIG. 3 illustrating the shape of the handle opening.

FIG. 3B is a cross-sectional view similar to that of FIG. 3 illustrating an alternate embodiment of the shape of the handle opening.

FIG. 4 is a cross-sectional view of the orbiting rod illustrating a lighted embodiment.

PREFERRED EMBODIMENTS OF THE INVENTION

Figure 5:
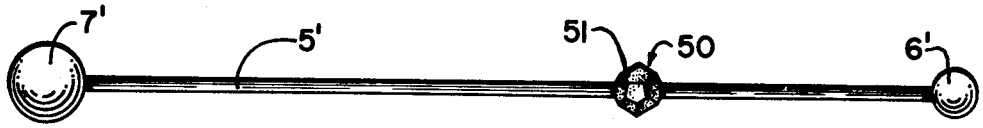
FIG. 5 is a perspective view of another preferred embodiment of the rod used in this invention.

In general, the toy novelty device of this invention comprises a hand-held elongated handle 1 having an opening 2 located at one end 3 and an orbiting rod, denoted generally by the number 4, having an elongated shaft 5 with a diameter less than that of opening 2 and having weighted ends 6 and 7.

In a preferred embodiment, ends 6 and 7 will be constructed from rubber, plastic, foam or other material having a resilient nature. It is further preferred for safety purposes that ends 6 and 7 of shaft 5 have rounded surfaces rather than sharp edges.

Another preferred embodiment is to vary the weights of ends 6 and 7. This embodiment enhances the performance of the toy and increases the skill necessary to operate the device and number of different operations that can be performed. To add interest, colored streamers 8 can be attached to either or both ends 6 and 7. In another embodiment shown in FIG. 2, ends 6 and 7 are provided with hollow cavities 9 and 10, respectively, in which metallic balls or rattlers 11 can be placed. In this embodiment, shaft 5 is provided with threads 12 and 13 at each end to receive end members 6 and 7 which are provided with mating threaded channels 14 and 15, respectively.

In another embodiment illustrated in FIG. 2A, shaft 5 is provided with a rounded or hook-shaped end 45 which preferably is encased in a plastic, rubber, foam or other resilient coating 46.

Although opening 2 can be of any number of shapes, it is preferred that it have a circular cross-section, and more preferred that opening edges 16, 16' be rounded or chamfered as shown in FIG. 3 and FIG. 3A, respectively. In a still more preferred embodiment, opening edges 16" will be slanted and slanted in the same direction such as in the shape of part of the side walls of an angled right circular cylinder.

In another preferred embodiment, handle 1 will have end section 17 provided with a flat or non-raised surface 18 where the operator's thumb 19 can rest. Surface 18 can be just an opening. With the thumb in the position shown, better control of the device's operation can be achieved.

Examining FIG. 4, one embodiment for providing a light assembly 20 at shaft end 7 is illustrated. Light assembly 20 comprises a metal casing 21 attached to end 7. Casing 21 is provided with a hollow chamber 22 into which fits, as shown, battery 23, metallic spring 24, and switch means 25. One end 26 of casing 21 is provided with a threaded section 27 for receiving mating threads 28 of light bulb 29. In a preferred embodiment, casing 21 is also provided with exterior threads 30 for receiving mating threads 31 of a clear covering 32. In the embodiment illustrated, switch means 25 comprises a non-conductive support frame 33 to which at one end 34 is attached a metallic contact plate 35. Contact plate 35 extends out from the exterior of frame 33 and contacts spring 24 when light bulb 29 is screwed into position. Attached to support frame side wall 36 and making contact with interior surface 37 of casing 21 is a metallic band 38. Band 38 is a thin circular metal strip forming a hollow cavity 39 within frame 33. At end 40 of frame 33 is a thin metallic plate 41 which also contacts interior surface 37, as well as, light bulb 29 when it is screwed into position. Finally, switch means 25 comprises a thin flexible metallic strip 42 attached at one end to plate 35 and extending out into support frame cavity 43 and into hollow cavity 39. Preferably, metallic weight 44 is attached to strip 42 at a position in cavity 39.

Figure 6:
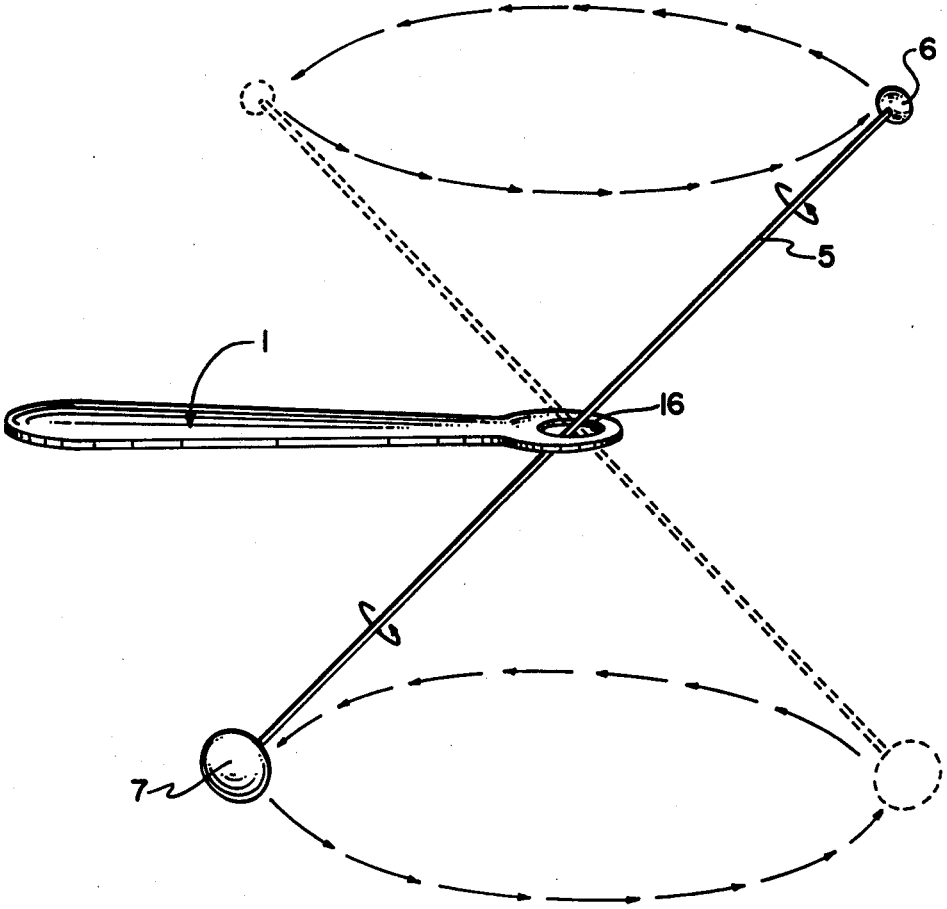
FIG. 6 is a perspective view of the motion of the orbiting rod when being manipulated by the handle.

In operating the basic device disclosed in FIGS. 1–3, orbiting rod 4 is placed through opening 2. Then with handle 1 held in one hand, rod 4 is set in a rotating motion by a person's second hand and is kept in motion by manipulating handle 1 in a combination of oscillatory and twisting motions. This results, as shown, in FIG. 6, of a dual conical motion, i.e., not only does the shaft 5 rotate about opening edge 16, but also rotates about its own longitudinal axis. A skilled operator can maintain the motion of rod 4 for extended periods of time, reverse the direction of the motion or cause rod 4 to move up and down through opening 2. In another embodiment where end 7 has a larger diameter than opening 2, the shaft 5 can be "ball socket" spun; i.e., shaft 5 is spun with end 7 adjacent to ring 47.

The operation of the lighted rod is identical to that described above. In this case, the centrifugal force placed on weighted end 44 forces it into contact with band 38 which action completes the electrical circuit causing light bulb 29 to become lit.

FIG. 5 illustrates a more preferred shaft 5' that is easier to manipulate and maintain. In particular, shaft 5' is provided with a third ball 50 fixed to shaft 5' at a position closer to end 6' than end 7' wherein end 6' weighs less than end 7'. Although ball 50 can be spherical, it is preferred to be faceted. These facets 51 help maintain ball 50 on opening edge 16 during operation.

There are, of course, many obvious variations and modifications to the specific embodiments disclosed, such as a hollow shaft 5, etc., and their inclusion within the scope of this invention is intended.

What I claim is:

1. A toy novelty device comprising:

(a) a hand-held elongated handle having an opening located in one end of said handle; and (b) an orbiting rod having an elongated straight, round shaft having a diameter sufficiently small to pass through said opening, said shaft having weight means attached at opposite ends of said shaft, at least one of said weight means being shaped to pass through said opening, said rod being positioned in said opening to achieve a dual conical pendulum motion when rotated about said opening.

2. A toy novelty device according to claim 1 wherein a cover constructed from resilient material is attached to each of said weighted means.

3. A toy novelty device according to claim 1 wherein said weighted means are of different weights.

4. A toy novelty device according to claim 1 wherein said opening is formed by a ring having rounded or chamfered edges.

5. A toy novelty device according to claim 4 wherein said opening has a circular cross-section.

6. A toy novelty device according to claim 1 wherein one of said ends are provided with a hollow cavity and wherein metal rattlers are located within said cavity.

7. A toy novelty device according to claim 1 wherein said orbiting rod comprises a third weight means fixedly attached closer to one end of said rod than to the opposite end of said rod.

8. A toy novelty device according to claim 7 wherein said third weighted means is spherical in shape and provided with flat facets about its surface.

9. A toy novelty device according to claim 1 wherein said handle comprises an end section opposite said openings, said end section comprising at least one flat surface of a length greater than a hand.

* * * * *